US006066994A

United States Patent [19]

Shepherd et al.

[11] Patent Number: 6,066,994

[45] Date of Patent: May 23, 2000

[54] BROADBAND DIRECTIONAL COUPLER INCLUDING AMPLIFYING, SAMPLING AND COMBINING CIRCUITS

[75] Inventors: Donald R. Shepherd, Lansdale; Frederick Schirk, Green Lane, both of Pa.

[73] Assignee: Amplifier Research Corporation, Souderton, Pa.

[21] Appl. No.: 09/080,871

[22] Filed: May 18, 1998

[51] Int. Cl.[7] ..... H01P 5/18

[52] U.S. Cl. ..... 333/109; 333/112; 333/115

[58] Field of Search ..... 333/109, 112, 333/115, 117, 118

[56] References Cited

U.S. PATENT DOCUMENTS

| | | | |
|---|---|---|---|
| 2,588,390 | 3/1952 | Jones | 333/112 X |
| 3,243,704 | 3/1966 | Jarger et al. | 333/112 X |
| 3,550,042 | 12/1970 | Werlau | 333/112 |
| 3,611,123 | 10/1971 | Mouw et al. | 333/112 X |
| 3,701,057 | 10/1972 | Hoer | 333/112 |
| 3,934,213 | 1/1976 | Stuckert | 333/112 |
| 4,034,289 | 7/1977 | Rozvlowicz et al. | 333/115 |
| 4,311,974 | 1/1982 | Reddy | 333/112 |
| 5,343,172 | 8/1994 | Utsu et al. | 333/32 |
| 5,425,052 | 6/1995 | Webster et al. | 333/112 |
| 5,745,016 | 4/1998 | Salminen | 333/109 |

OTHER PUBLICATIONS

W.W. Mumford, "Directional Couplers" *Proceedings of the I.R.E.*, 35(2):160–167 (Feb. 1947).

I. Gottlieb, *Practical RF Power Design Techniques*, TAB Books, pp. 182–184 (1993).

*Primary Examiner*—Benny Lee

*Attorney, Agent, or Firm*—Howson & Howson

[57] ABSTRACT

A directional coupler for r.f. power measurement utilizes a capacitive voltage divider connected to the center conductor of a length of transmission line. The output of the divider is connected to the input of a field effect transistor amplifier, which makes the divider essentially frequency independent over a wide frequency range. The outer conductor of the transmission line comprises two sections separated by a gap and connected to each other by an annular resistor permitting a current sample to be tapped. The annular resistor is disposed between two parallel circuit boards disposed in radial planes. Circuit components, including the field effect transistor amplifier are mounted on one of the boards. The output of the amplifier and the current sample are combined algebraically at a junction to provide a signal representing forward or reflected power in the transmission line.

13 Claims, 4 Drawing Sheets

BROADBAND DIRECTIONAL COUPLER INCLUDING AMPLIFYING, SAMPLING AND COMBINING CIRCUITS

BACKGROUND OF THE INVENTION

This invention relates to radio frequency power measurement, and more specifically to improvements in directional couplers used to make such measurements.

A directional coupler is a device which measures the power in a wave traveling in a particular direction in a transmission line. Most directional couplers used in conjunction with radio frequency power amplifiers are designed to measure both forward and reflected power. These directional couplers are useful in measuring load conditions, in adjusting the matching between the amplifier output stage and the load, and in protecting the output devices of an amplifier from damage resulting from mismatch.

An early type of directional coupler utilized a secondary transmission line loosely coupled to a primary transmission line at two points spaced from each other by an odd multiple of one quarter wavelength. In this type of directional coupler, the forward wave in the primary line produces a wave which travels in a first direction in the secondary line and which can be measured at a termination at one end of the secondary line. A reflected wave in the primary line produces a wave which travels in the secondary line toward the opposite termination, where it can be measured. This early type of directional coupler is, of course, highly frequency-dependent. Greater bandwidths can be obtained by utilizing more than two coupling points. However, the added coupling increases the complexity of the device.

A second type of directional coupler takes advantage of the fact that the current and voltage in a forward traveling wave in a transmission line are in phase while the current and voltage in the reflected wave are 180° out of phase. The current and the voltage are sampled at both ends of a section of transmission line. In each case, the current sample is converted to a voltage sample which is combined with the voltage sampled at the same end of the line. At the input end of the section of transmission line, the components of the voltage samples which correspond to the voltage and current of the forward wave are added, and the components of the voltage samples which correspond to the voltage and current of the reflected wave are subtractively combined. At the load end of the transmission line section, the components of the voltage samples which correspond to the voltage and current of the forward wave are subtractively combined, and the components of the voltage samples which correspond to the voltage and current of the reflected wave are added. Therefore, the voltage resulting from the addition at the input end is proportional to the forward power, and the voltage resulting from the addition at the load end is proportional to reflected power.

In a typical directional coupler of the second type, the voltage sample is derived through a resistive voltage divider. Unfortunately, physically small resistors in the divider have a limited heat dissipating capability and therefore impose limits on the power handling capacity of the directional coupler. On the other hand, physically larger resistors having a greater heat dissipating capability also have a higher inductance, and impose an upper limit on the frequency range in which the directional coupler can operate. High resistance values would avoid the heat dissipation and inductance problems, but produce erratic voltage samples because of interaction with reactances elsewhere in the circuit.

It is possible to use a pair of capacitors in series as a voltage divider in place of a resistive divider. However, in a typical directional coupler utilizing a capacitive voltage divider, one of the two capacitors, usually the one having the higher capacitance, is shunted by a relatively low resistance branch comprising a milliammeter in series with a resistor. The low resistance branch makes the response of the divider highly frequency-dependent, causing difficulties in calibration and also imposing limits on the frequency range in which the directional coupler can operate.

SUMMARY OF THE INVENTION

The principal object of this invention is to provide a directional coupler which is capable of making accurate measurements of forward and/or reflected power in an r.f. transmission line over a wide range of frequencies. It is also an object of the invention to provide an accurate directional coupler which is capable of operating at relatively high r.f. power levels. Still another object of the invention is to provide a directional coupler having a very low insertion loss.

The directional coupler in accordance with the invention addresses the aforementioned problems of frequency dependence and power dissipation by utilizing a capacitive voltage divider in combination with an amplifying device, preferably one having a high input impedance, such as a field effect transistor (FET). The amplifier eliminates the low resistance shunt across one of the capacitors and allows the divider to operate over a relatively broad frequency range. Satisfactory operation at frequencies from below 100 KHz. to above 1 GHz. has been achieved, making the device especially suitable for r.f. susceptibility testing at high power levels, e.g. at power levels in excess of 100 watts. The use of a capacitive voltage divider also eliminates the dissipation which would occur with a resistive voltage divider, and therefore achieves a lower overall insertion loss.

More specifically, the invention is a broadband directional coupler for producing an output signal representative of the power in a wave traveling in a two-conductor transmission line. Two capacitors, connected in series at a junction, are connected from one of the conductors of the transmission line to a ground. An amplifier has an input connected to the junction of the two capacitors, and produces a first signal having an amplitude which is a function of the voltage at the junction. A sampling circuit produces a second signal having an amplitude which is a function of the current in the other conductor, and a combining circuit receives the first and second signals and provides an output signal proportional to an algebraic combination (i.e. addition or subtraction) of the amplitudes of the first and second signals.

The invention can be embodied in a dual directional coupler, in which voltage and current samples are taken at two points along a transmission line, and in which the amplitudes of the signals derived from voltage and current sampled at one point are additively combined and the amplitudes of the signals derived from voltage and current sampled at the other point are subtractively combined. The result of the additive combination is representative of the forward power in the transmission line, and the result of the subtractive combination is representative of the reflected power.

In a preferred embodiment, the device includes a section of two-conductor transmission line having a gap in one of the conductors with a resistance connected across the gap to provide a sample of the current in the line. In the case of a dual directional coupler, the transmission line section has two such gaps, each with a resistance connected across it. In the case of a coaxial transmission line, the resistances are preferably ring-shaped resistive elements located in gaps in the outer conductors of the line. The use of resistances, especially ring-shaped resistive elements, in gaps in a conductor of the line, provides an exceptionally good broadband frequency response characteristic.

Thus the invention provides an accurate directional coupler having a very broad bandwidth, a high power handling capability, and low insertion loss. Other objects, details and advantages of the invention will be apparent from the following detailed description when read in conjunction with the drawings.

DETAILED DESCRIPTION OF THE INVENTION

Figure 1:
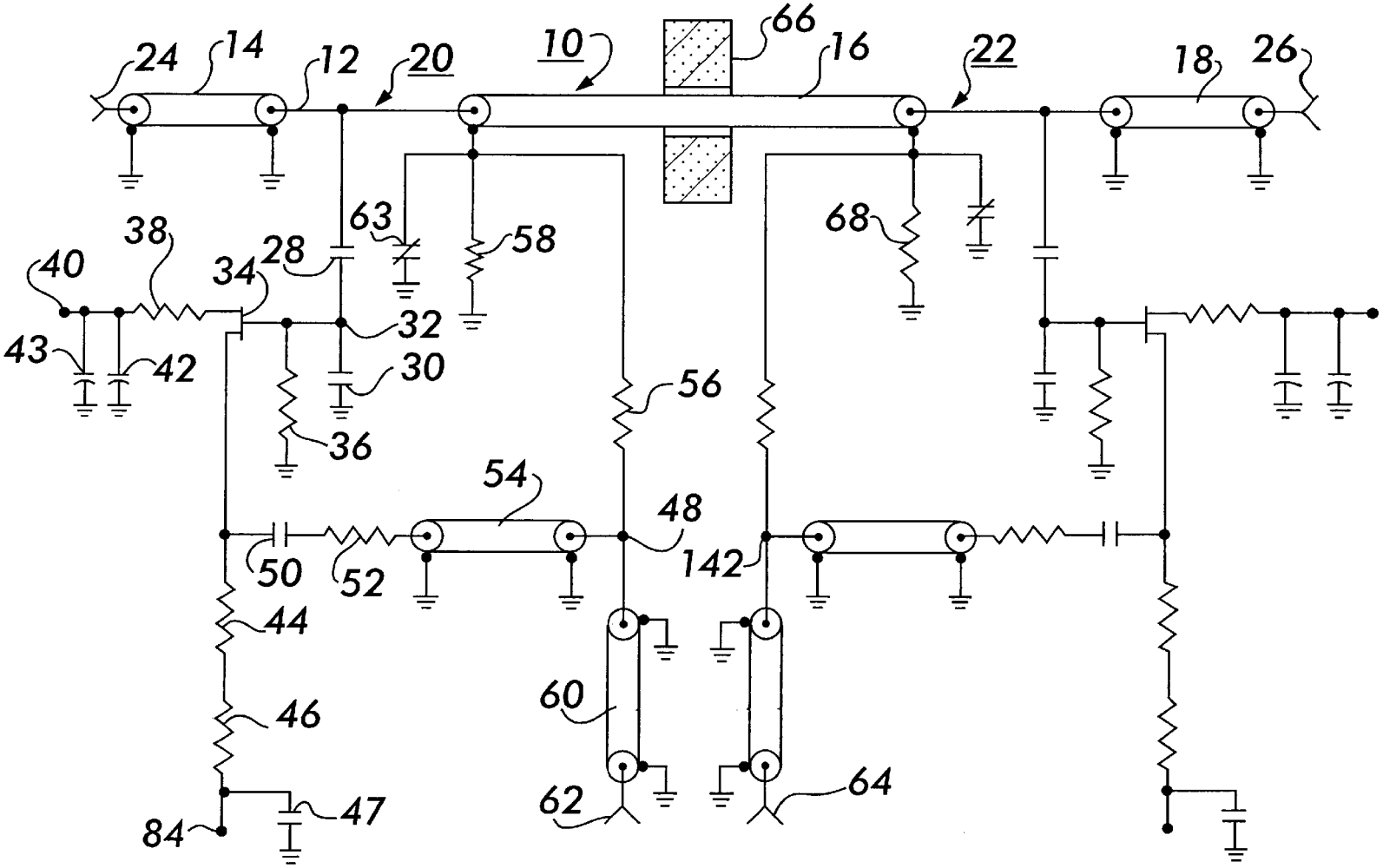
FIG. 1 is a schematic diagram of a dual directional coupler in accordance with the invention.

Before describing the mechanical details of the directional coupler, its electrical configuration and its general operation will be described with reference to FIG. 1.

A length of coaxial transmission line 10 has an inner conductor 12. The inner conductor is continuous, although for convenience of fabrication of the transmission line, the inner conductor can be made up of multiple, separable parts. The tubular outer conductor of the transmission line 10 is divided into three sections, 14, 16 and 18, by gaps 20 and 22. The inner conductor 20 has a terminal 24 at one end adapted to be connected to an r.f. source, for example the output stage of an r.f. power amplifier, and a terminal 26 at its other end adapted to be connected to a load, for example an antenna, or a testing apparatus such as an E-field generator or a TEM cell.

The dimensions and dielectric material of coaxial transmission line 10 are preferably selected for an appropriate characteristic impedance $Z_0$ to match the output impedance of the source. Typically, although not necessarily, the characteristic impedance of the coaxial transmission line 10 will be 50Ω.

As shown, the outer conductor, or sheath, of section 14 of the transmission line is connected at both ends to a ground. At the location of gap 20, the series combination of capacitors 28 and 30 is connected between the inner conductor 12 and a ground. As will be apparent from the mechanical description to follow, the ground to which capacitor 30 is connected is physically close to the right-hand end of the outer conductor of section 14. The capacitance of capacitor 28 is typically 0.26 pF.

Capacitor 30 is typically a 22 pF capacitor.

The junction 32 of the two capacitors is connected to the gate of a Gallium Arsenide field effect transistor (FET) 34 of the depletion mode type. The gate of the FET is connected to ground through a resistor 36, and the drain of the FET is connected through a resistor 38 to a terminal 40 for connection to the positive side of a DC supply (the negative side of the supply being connected to the ground). A by-pass capacitor 42 is connected between terminal 40 and ground, and another by-pass capacitor is provided at 43. DC power is supplied to terminal 40 (and to a corresponding terminal on the other side of the circuit) by way of a feed-through capacitor (not shown in FIG. 1).

The source of FET 34 is connected through resistors 44 and 46 to a terminal 84, which is connectible to the negative side of a second DC supply, the positive side of which is connected to ground. A by-pass capacitor 47 is connected between the negative DC supply line and ground. The source of the FET is also connected to a junction 48 through the series combination of a capacitor 50, a resistor 52 and a length 54 of coaxial line. As will be apparent, the FET is connected in a "source-follower" configuration, so that it serves, in effect, as an active impedance converter, having an input impedance significantly higher than its output impedance.

The junction 48 is connected through a resistor 56 to the outer conductor of the intermediate section 16 of the coaxial transmission line 10 at a point adjacent to gap 20. At the same end of the intermediate section 16, the outer conductor is connected through a resistor 58 to ground. As will be apparent from the mechanical description to follow, the resistor 58 is connected directly across gap 20 from the outer conductor of section 16 to the outer conductor of section 14. Junction 48 is connected through a coaxial line 60 to a "forward power" output terminal 62. A trimmer capacitor 63 is connected between the end of the outer conductor of transmission line section 16 and ground.

The device is symmetrical. That is, the circuitry at the opposite end of the intermediate section 16 is identical to the circuitry just described, and delivers a signal representing reflected power to a "reflected power" output terminal 64. A toroidal ferrite element 66 is disposed around coaxial transmission line section 16 to increase its inductance, and better isolate one end from the other at low frequencies. At either end of the coaxial transmission line section 16, The "forward power" and "reflected power" output terminals 62 and 64 can be connected to suitable meters, e.g. r.f. power meters, to display forward and reflected power. Alternatively, these output terminals 62 and 64 can be connected to a feedback loop for controlling the output level of a power amplifier delivering r.f. power through the directional coupler to a load. The feedback signal can be used, for example, to maintain a constant power output to the load as the frequency is swept through a range of frequencies, or to decrease the output power of the amplifier when the reflected power indicates an unacceptably high voltage standing wave ratio (VSWR) in the transmission line between the amplifier and the load.

The following tabulation shows the parameters of the various components of a typical directional coupler corresponding to FIG. 1:

| | |
|---|---|
| Capacitor 28 | 0.26 pF |
| Capacitor 30 | 22 pF |
| FET 34 | ATF-25735 |
| Resistor 36 | 100 KΩ |
| Resistor 38 | 100 Ω |

-continued

| | |
|---|---|
| Resistor 44 | 390 Ω |
| Resistor 46 | 390 Ω |
| Capacitor 50 | 0.039 μF |
| Resistor 52 | 82 Ω |
| Resistor 56 | 84 Ω |
| Resistor 58 | 0.45 Ω |

For effective operation of the directional coupler, especially at frequencies approaching or exceeding 1 GHz, it is important to lay out the discrete components in such a way as to minimize undesired capacitive and inductive effects. To this end, the directional coupler comprises a coaxial transmission line, the outer conductor of which is interrupted. There are two interruptions in the case of a dual directional coupler. At each interruption, the gap in the outer conductor is spanned by a circular resistor. The resistor is disposed between two printed circuit boards the faces of which are in radial planes. The discrete components associated with the resistor are mounted on one of the circuit boards.

Figure 2:
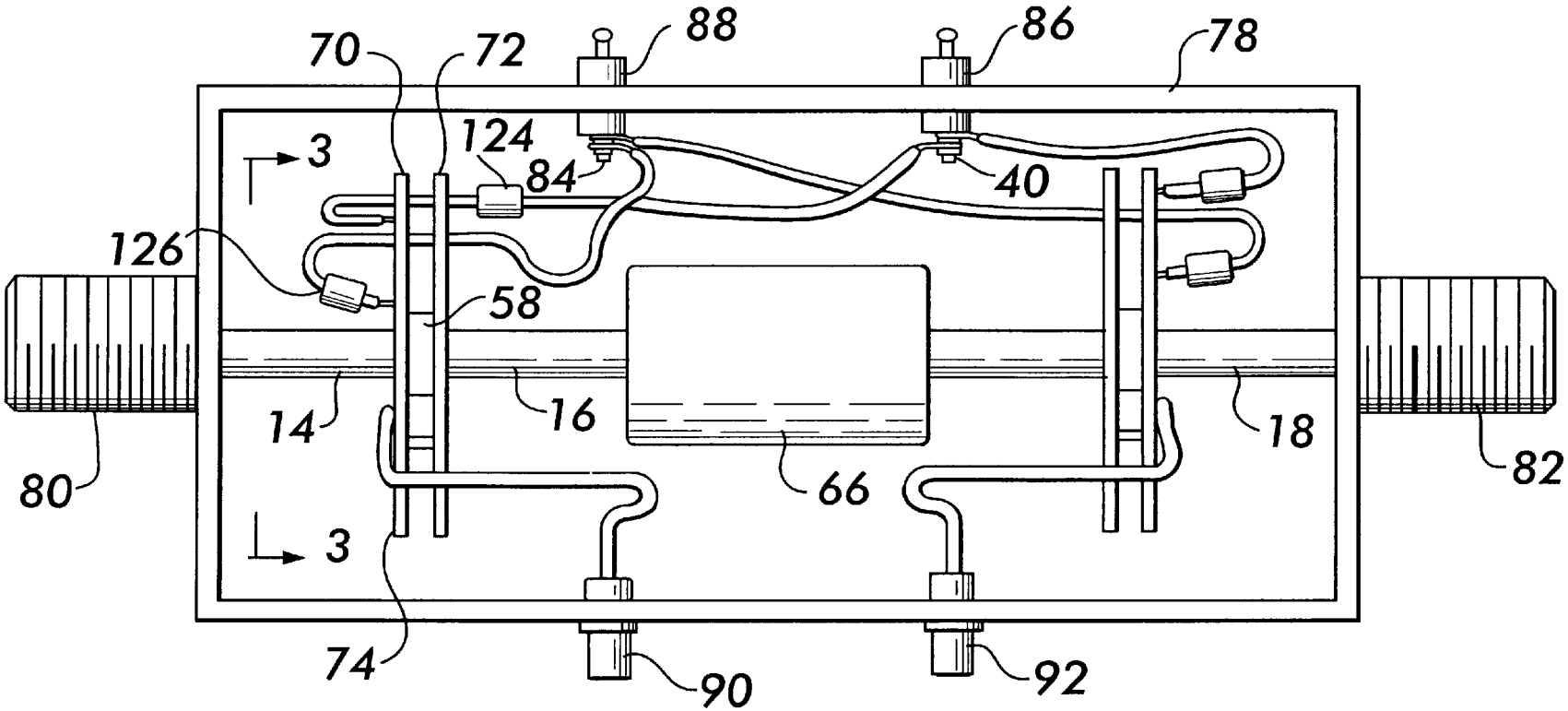
FIG. 2 is a side elevational view showing the structure of the directional coupler.

As shown in FIG. 2, resistor 58, which is a 0.45Ω annular resistor, is located between two circuit boards 70 and 72. Most of the discrete components associated with the forward power measuring section of the coupler are mounted on face 74 of circuit board 70. The transmission line, which comprises sections 14, 16 and 18, is located in an enclosure 78, having an input coaxial connector 80 and an output coaxial connector 82 at opposite ends. D.C. power terminals are provided at 40 and 84 on feed-through capacitors 86 and 88. A small coaxial connector 90 delivers a forward power output signal and a similar small coaxial connector 92 delivers a reverse power output signal. The toroidal ferrite element 66, surrounding the intermediate section 16 of the transmission line, is also seen in FIG. 2. FIG. 2 also shows ferrite beads 124 and 126, which are provided respectively on positive and negative DC supply lines.

Figure 3:
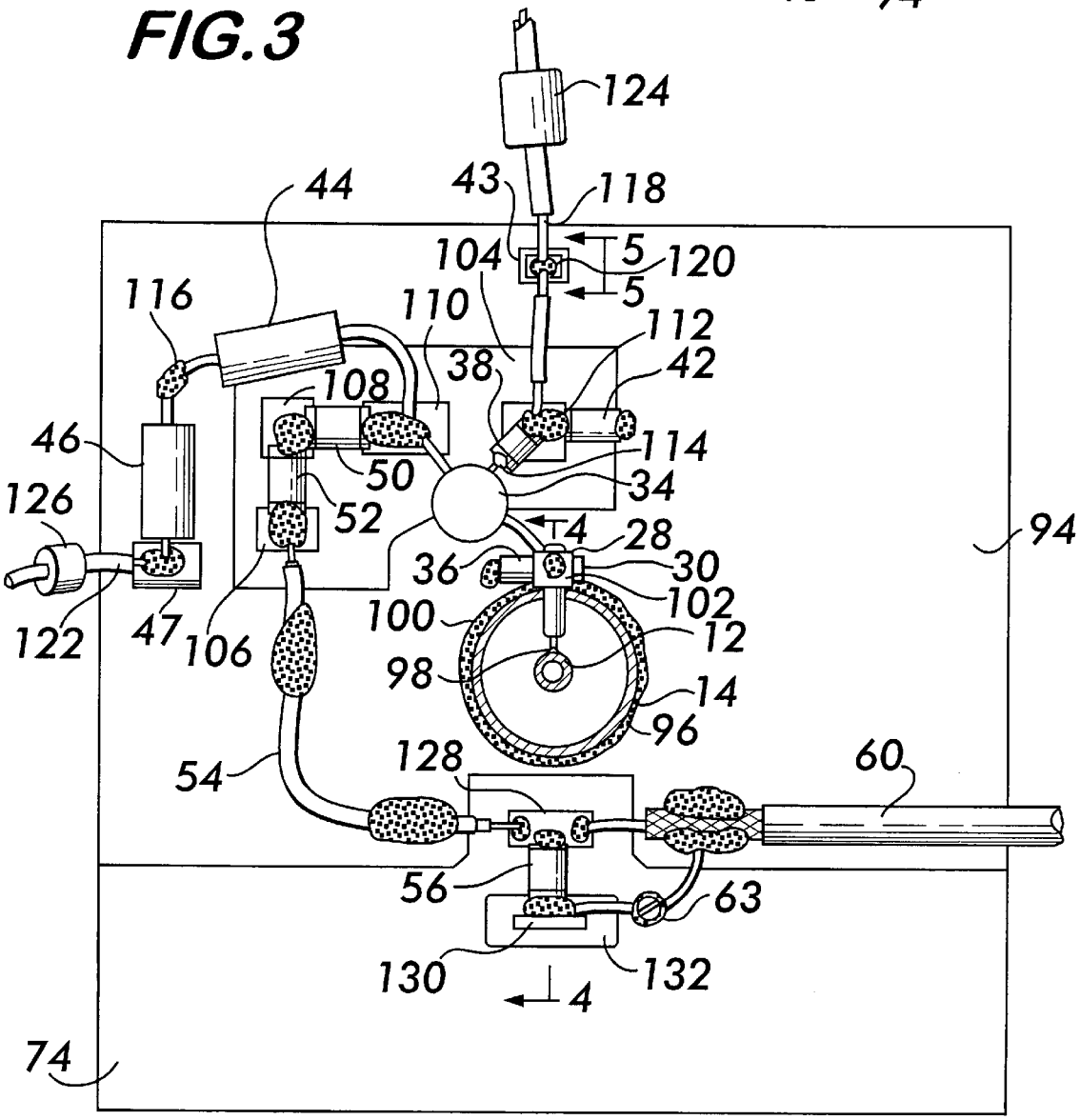
FIG. 3 is a sectional view, taken on plane 3—3 in FIG. 2, showing a typical layout of the components of FIG. 1 on a circuit board.
Figure 4:
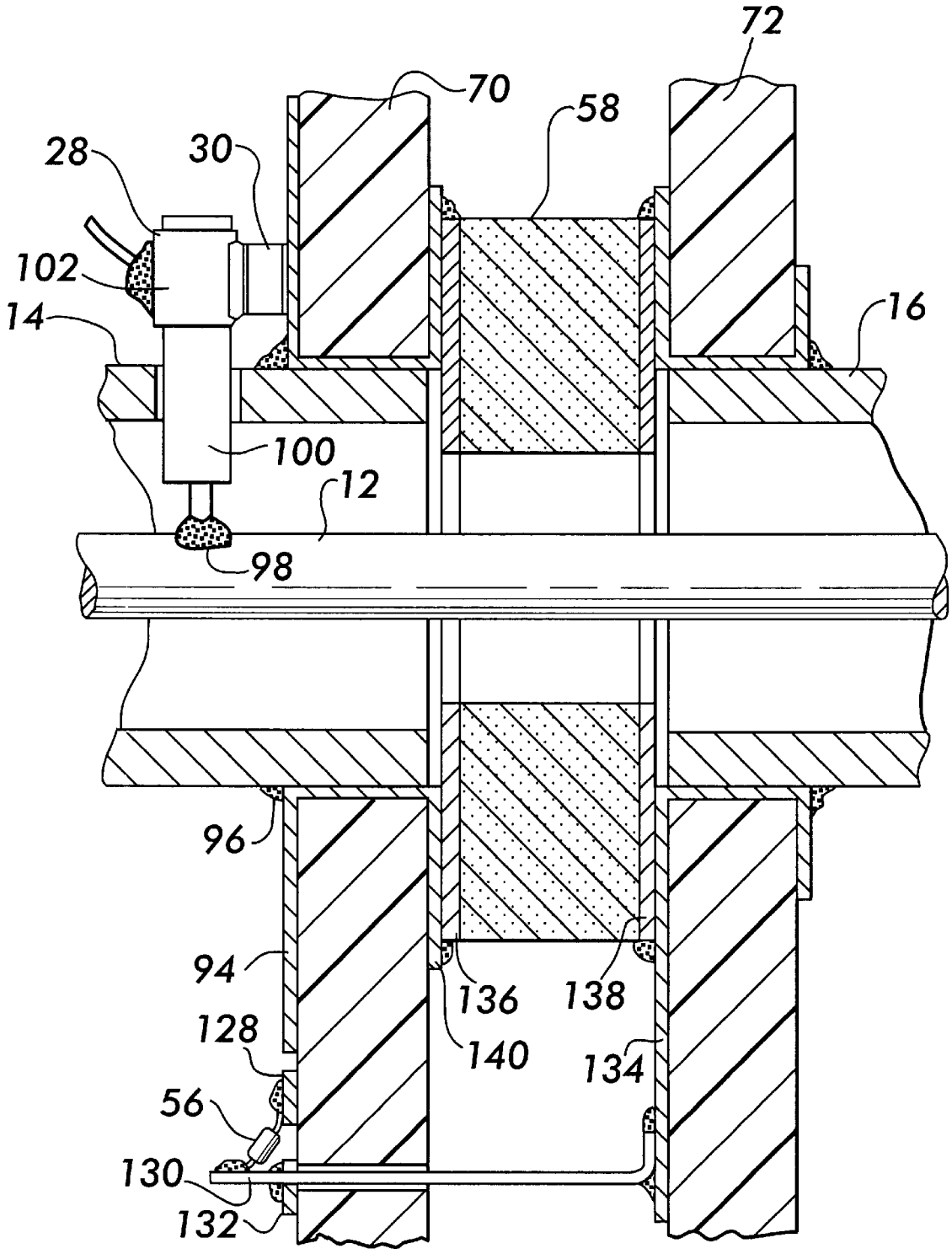
FIG. 4 is a sectional view taken on surface 4—4 in FIG. 3, showing details of the electrical connections to the transmission line of the directional coupler.

FIG. 3 shows that face 74 of circuit board 70 has a large conductive foil area 94. This area corresponds to the ground in FIG. 1. Most of the resistors on the circuit board are preferably thick film chip resistors, and likewise most of the capacitors are preferably chip-type capacitors. As shown in FIGS. 3 and 4, the outer conductor of section 14 of the coaxial transmission line is soldered to the foil area 94 at 96. Capacitor 28 is constituted by the inner and outer conductors of a short length of small diameter coaxial transmission line. The center conductor of this short length of small diameter transmission line is soldered to the inner conductor 12 of section 14 at solder joint 98. Part of the outer conductor of the short length of transmission line is stripped away, leaving the inner conductor and its insulation 100, which extend radially through a hole formed in the outer conductor of transmission line section 14. The outer conductor 102 of the short, small diameter transmission line is not connected to the transmission line section 14, and it serves not only as a part of capacitor 28, but also as junction 32 (see FIG. 1), to which chip capacitor 30, chip resistor 36 (see FIG. 3) and the gate of field effect transistor 34 (see FIG. 3) are connected.

Figure 5:
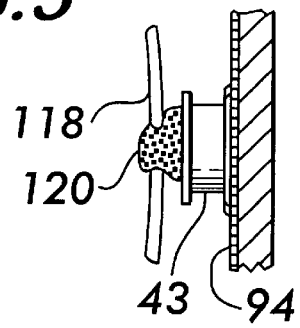
FIG. 5 is a sectional view taken on plane 5—5 of FIG. 3, showing details of a by-pass capacitor for one of the direct current power supply wires.

FIG. 3 shows a non-conductive area 104, surrounded by the conductive foil 94. Within this area 104, small conductive foil areas 106, 108, 110 and 112 form junctions to which various components are soldered Capacitors 50 and 52 are connected to each other at a junction formed by foil area 108. Junction 114, connecting chip resistor 38 with the drain of FET 34, is not connected to the foil of the circuit board. Likewise junction 116, which connects resistors 44 and 46, is not connected to the foil of the circuit board. By-pass capacitor 43 is in the form of a chip capacitor, one side of which is soldered to the circuit board foil 94 as shown in FIG. 5. A positive DC power supply line 118 is soldered to the other side of capacitor 43 at solder joint 120 (See FIGS. 3, 5). Capacitor 42 is shown connected between the positive supply line 118 and circuit board foil 94. By-pass chip capacitor 47 is connected between a negative DC power supply line 122 and circuit board foil 94. Ferrite bead 124 is provided on the positive DC line 118 and a ferrite bead 126 is provided on the negative DC line 122. Similar ferrite beads are provided on the DC supply lines serving the identical opposite side of the circuit, as shown in FIG. 2.

As shown in FIG. 3, the outer conductors of coaxial lines 54 and 60 are soldered to circuit board foil 94. Their inner conductors are joined to each other at a circuit board foil area 128. Resistor 56 is connected between this foil area 128 and a metal conductor 130, which, as shown in FIG. 4, is soldered to a foil area 132 and extends through the circuit board 70 to a foil area 134 on circuit board 72 (not shown in FIG. 3). Both conductor 130 and the outer conductor of transmission line section 16 are soldered to foil area 134, as shown in FIG. 4. Referring again to FIG. 3, trimmer capacitor 63, is connected to ground by virtue of its being soldered at one end to foil 94, and is connected to an end of the outer conductor of coaxial section 64 by virtue of its being soldered to conductor 130.

As shown in FIG. 4, resistor 58 is annular in shape, and coaxial with center conductor 12 of the transmission line 10. Its resistive element is disposed between two metal plates 136 and 138, which are connected to conductive foil surfaces 140 and 134 respectively on the boards, for example by conductive epoxy or solder. The outer conductors of transmission line sections 14 and 16 extend into plated-through holes in boards 70 and 72 respectively, and are soldered to foil areas on the sides of the boards facing away from each other, for example by solder joint 96. Resistor 58 becomes a part of the outer conductor of transmission line 10, having a resistance of 0.45Ω FIG. 4 also shows resistor 56, which is connected between the foil area 128 and conductor 130.

The circuit boards at the opposite end of transmission line section 16 and their associated components can be, and preferably are, identical to the circuit boards and components just described. The provision of pairs of parallel circuit boards to which the transmission line is perpendicular and an annular resistor between the circuit boards of each pair makes it possible to locate the circuit components in very close proximity to the transmission line, thereby minimizing inductances and capacitances that would affect the upper frequency limit at which the directional coupler can operate.

The operation of the directional coupler will now be described briefly. At each end of the transmission line section 16, the current in the outer conductor is equal to the current on the center conductor. The direction of the current in the outer conductor will be opposite to that in the center conductor. The relationship between the direction of the current in resistor 58 and the current in the center conductor will always be opposite to the relationship between the current in resistor 68 and the current in the center conductor.

As shown in FIG. 1, at the input end of the transmission line section 16, the current in the outer conductor is tapped, and a sample is carried by resistor 56 to junction 48. This sample is a current proportional to the current in the transmission line. The voltage on the inner conductor is also tapped by the capacitive voltage divider comprising capacitors 28 and 30. The field effect transistor, which is in a source-follower configuration, delivers a sample current, through capacitor 50, resistor 52 and coaxial line 54, which is proportional to the voltage on the center conductor of the transmission line 10. The two sample currents are combined algebraically at junction 48, and assuming a resistive load at terminal 62, the algebraic combination of the sample currents produces a current proportional to the square root of the forward power.

At terminal 64, a similar current sample representing reflected power is produced by the algebraic combination of currents representing the current and center conductor voltage at the output end of transmission line section 16. It should be noted that because the outer conductor currents are tapped at the output end of resistor 58, but at the input end of resistor 68, the algebraic combination in the forward power circuit is opposite to the algebraic combination in the reflected power circuit. Thus, current samples are added at junction 48 in the forward power circuit and subtracted at the corresponding junction 142 in the reflected power circuit.

With a load at terminal 26 matched to the characteristic impedance of the transmission line 10, the currents at junction 48 are both non-zero and add to each other to produce a forward power signal at terminal 62. The currents at junction 142, however, are subtracted, producing a zero or near zero reflected power signal at terminal 64.

If terminal 26 is short circuited, the voltage on the inner conductor goes to zero but the current in the outer conductor goes to double its normal level. This produces the same forward power output terminal 62 as in the case of a matched load. However, because there is a zero voltage on the inner conductor, no subtraction of currents takes place at junction 142, and the current sample delivered to reflected power output terminal 64 is proportional to double the normal current in the outer conductor, indicating 100% reflected power.

An open circuit at terminal 26 produces a similar result. When the transmission line operates into an open circuit, the voltage on its inner conductor is double its normal value, but the current in the outer conductor is zero. The doubled voltage on the inner conductor produces a full forward power reading at forward power terminal 62, but also produces a 100% reflected power signal at reflected power terminal 64.

It can be appreciated intuitively, and demonstrated both mathematically and empirically, that intermediate degrees of mismatch at the output terminal of the directional coupler will also result in accurate forward and reflected power signals at terminals 62 and 64.

The use of a capacitive voltage divider avoids the problems encountered with conventional resistive voltage dividers, namely power losses due to the dissipation of heat, the overheating of low-wattage resistors, the inductive effects of resistors that are physically large enough to dissipate the heat generated in them, and erratic readings that a divider made up of relatively high resistances would cause.

The amplifying device, which is in a source-follower configuration, serves as an active impedance converter. The relatively high input impedance of the amplifying device reduces the frequency dependence of the capacitive voltage division circuit by effectively eliminating a low resistance shunt across capacitor 30. The effective elimination of the low shunt resistance not only makes the capacitive divider essentially frequency independent but also enables the divider to operate at low frequencies, where a low resistance load in combination with a high series capacitive reactance would seriously attenuate the output signal and produce false readings. The directional coupler in accordance with the invention can produce useful forward and reflected power outputs over a range extending from below 100 KHz to above 1 GHz.

Various modifications can be made to the directional coupler. For example, when the directional coupler is connected to the output of an r.f. power amplifier, instead of displaying the forward and reflected power output signals, these signals can be fed back to a power reduction circuit for protecting the amplifier when a serious mismatch is detected. Bipolar transistors can be used in place of FETs as amplifying devices in the directional coupler. However, because of the lower input impedance of a bipolar transistor amplifier, the frequency range of the circuit will generally be more limited. Various amplifier configurations other than source-follower or emitter-follower can be used to connect the output of the capacitive voltage divider to the algebraic combination circuit.

The directional coupler can be modified for use with transmission lines other than coaxial, for example, parallel conductor lines. Still other modifications may be made to the apparatus and method described above without departing from the scope of the invention as defined in the following claims.

What is claimed is:

1. A broadband directional coupler for producing an output signal representative of the power in a wave traveling in a two-conductor transmission line comprising:

a pair of capacitors connected in series from one of the conductors of the transmission line to a ground, the capacitors being connected to each other at a junction;

an amplifier having an input connected to said junction, the amplifier producing a first signal having an amplitude which is a function of a voltage at said junction;

a circuit for sampling a current in the other conductor of the transmission line and producing a second signal having an amplitude which is a function of the current in said other conductor; and a combining circuit, connected to receive the first and second signals, for providing an out put signal proportional to an algebraic combination of the amplitudes of the first and second signals.

2. A broadband directional coupler according to claim 1, in which the amplifier comprises a field-effect transistor.

3. A broadband directional coupler for producing output signals representative of forward and reflected power in a two-conductor transmission line connected from an r.f. power source to a load comprising:

a first pair of capacitors connected in series from a first point on one of the conductors of the transmission line to a ground, the capacitors of the first pair being connected to each other at a first junction;

a first amplifier having an input connected to said first junction, the first amplifier producing a first signal having an amplitude which is a function of a voltage at said first junction;

a first circuit for sampling a current in the other conductor of the transmission line and producing a second signal having an amplitude which is a function of the current in said other conductor;

a second pair of capacitors connected in series from a second point on said one of the conductors of the transmission line to a ground, the capacitors of the second pair being connected to each other at a second junction;

a second amplifier having an input connected to said second junction, the second amplifier producing a third signal having an amplitude which is a function of a voltage at said second junction;

a second circuit for sampling a current in said other conductor of the transmission line and producing a fourth signal having an amplitude which is a function of the current in said other conductor;

a first combining circuit, connected to receive the first and second signals, for providing an output signal proportional to the sum of the amplitudes of the first and second signals; and a second combining circuit, connected to receive the third and fourth signals, for providing an output signal proportional to the difference between the amplitudes of the third and fourth signals.

4. A broadband directional coupler according to claim 3, in which each of the first and second amplifiers comprises a respective field effect transistor.

5. A broadband directional coupler for producing an output signal representative of the power in a wave traveling between an r.f. power source and a load:

a two-conductor transmission line connectible from the r.f. power source to the load, one conductor of the transmission line being interrupted by a gap, whereby said one conductor is divided into first and second sections, the first and second sections being spaced from each other by the gap;

a resistance connected across the gap from the first section to the second section;

a pair of capacitors connected in series, from the other conductor of the transmission line to the first section of said one conductor, the capacitors being connected to each other at a junction;

an amplifier having an input connected to said first junction, the amplifier producing a first signal having an amplitude which is a function of a voltage at said junction;

a circuit for sampling a current in the resistance and producing a second signal having an amplitude which is a function of the current in said resistance; and a combining circuit, connected to receive the first and second signals, for providing an output signal proportional to the an algebraic combination of the amplitudes of the first and second signals.

6. A broadband directional coupler according to claim 5, in which the amplifier comprises a field-effect transistor.

7. A broadband directional coupler for measuring forward and reflected power in a path between an r.f. power source and a load comprising:

a two-conductor transmission line connectible from a power source to the load, one conductor of the transmission line being interrupted by a pair of gaps at spaced locations, whereby said one conductor is divided into first, second and third sections, the first and second sections being spaced from each other by a first one of said gaps and the second and third sections being spaced from each other by a second one of said gaps;

a first resistance connected across the first gap from the first section to the second section;

a second resistance connected across the second gap from the second section to the third section;

a first pair of capacitors connected in series, from the other conductor of the transmission line to the first section of said one conductor, the capacitors of the first pair being connected to each other at a first junction;

a second pair of capacitors connected in series, from said other conductor of the transmission line to the third section of said one conductor, the capacitors of the second pair being connected to each other at a second junction;

a first amplifier having an input connected to said first junction, the first amplifier producing a first signal having an amplitude which is a function of a voltage at said first junction;

a first circuit for sampling a current in the first resistance and producing a second signal having an amplitude which is a function of the current in said first resistance;

a second amplifier having an input connected to said second junction, the second amplifier producing a third signal having an amplitude which is a function of a voltage at said second junction;

a second circuit for sampling a current in the second resistance and producing a fourth signal having an amplitude which is a function of the current in said second resistance;

a first combining circuit, connected to receive the first and second signals, for providing an output signal proportional to the sum of the amplitudes of the first and second signals; and a second combining circuit, connected to receive the third and fourth signals, for providing a second output signal proportional to the difference between the amplitudes of the third and fourth signals.

8. A broadband directional coupler according to claim 7, in which each of the first and second amplifiers comprises a respective field effect transistor.

9. A broadband directional coupler for producing an output signal representative of the power in a wave traveling in a two-conductor transmission line comprising:

a coaxial line connectible in series with a two-conductor transmission line, the coaxial line comprising a continuous center conductor extending along an axis, and a tubular outer conductor coaxial with the inner conductor and having a gap whereby the tubular outer conductor is divided into two separate sections spaced from each other along the axis by said gap;

a resistor connecting the two separate sections of the outer conductor, the resistor being circular in shape and having a central passage through which the continuous center conductor of the coaxial line extends; and a conductor, connected to the resistor, for delivering an output signal proportional to a current in the outer conductor.

10. A broadband directional coupler according to claim 9, in which one of the sections of the outer conductor has an aperture located adjacent to the resistor, and including a second conductor, connected to the continuous inner conductor and extending through the aperture, for delivering an output signal proportional to the voltage in the continuous center conductor.

11. A broadband directional coupler according to claim 9, including circuit means for combining said output signals to produce a third signal representative of forward or reflected power in the transmission line.

12. A broadband directional coupler according to claim 9, including a circuit board having opposite faces disposed in respective planes to which said axis is perpendicular, said circuit means comprising components mounted on the circuit board.

13. A broadband directional coupler according to claim 9, including first and second circuit boards each having opposite respective faces disposed in corresponding planes to which said axis is perpendicular, said resistor being located between the circuit boards and having opposite ends one of which is electrically connected to a conductor on the first circuit boards and the other of which is electrically connected to a conductor on the second circuit board, said circuit means comprising components mounted on the first circuit board and including a conductor extending between the circuit boards and connecting at least one component on said first circuit board to said conductor on the second circuit board.

* * * * *